US008661595B2

(12) United States Patent
Bernini

(10) Patent No.: US 8,661,595 B2
(45) Date of Patent: Mar. 4, 2014

(54) AUTOMATIC SWIMMING POOL CLEANING MACHINE

(76) Inventor: Fabrizio Bernini, Bucine (IT)

( * ) Notice: Subject to any disclaimer, the term of this patent is extended or adjusted under 35 U.S.C. 154(b) by 31 days.

(21) Appl. No.: 13/472,263

(22) Filed: May 15, 2012

(65) Prior Publication Data

US 2013/0031729 A1 Feb. 7, 2013

(30) Foreign Application Priority Data

Aug. 4, 2011 (EP) ..... 11425212

(51) Int. Cl.
*E04H 4/16* (2006.01)

(52) U.S. Cl.
USPC ..... 15/1.7; 210/167.16

(58) Field of Classification Search
USPC ..... 15/1.7; 210/167.16, 173, 167.17, 416.2; 241/101.74, 101.742, 46.017
See application file for complete search history.

(56) References Cited

U.S. PATENT DOCUMENTS

| | | | | |
|---|---|---|---|---|
| 3,906,572 | A * | 9/1975 | Winn | 15/1.7 |
| 4,902,412 | A * | 2/1990 | Surber et al. | 210/167.13 |
| 7,037,038 | B1 * | 5/2006 | Haski et al. | 405/60 |
| 2006/0174430 | A1 * | 8/2006 | Pareti | 15/1.7 |
| 2008/0236628 | A1 | 10/2008 | Horvath et al. | |
| 2009/0282627 | A1 * | 11/2009 | Porat | 15/1.7 |

FOREIGN PATENT DOCUMENTS

| | | | | |
|---|---|---|---|---|
| EP | 1785552 | A2 * | 5/2007 | E04H 4/16 |

* cited by examiner

*Primary Examiner* — Mark Spisich
*Assistant Examiner* — Andrew A Horton
(74) *Attorney, Agent, or Firm* — Lucas & Mercanti, LLP

(57) ABSTRACT

Described is an automatic cleaning machine for swimming pools comprising a body with at least two motorized wheels for moving on a drive surface, at least one suction inlet positioned on a lower surface of the body, at least one outlet mouth, at least one turbine, operating between the suction inlet and the outlet mouth, controllable by a respective electricity supply battery, an electronic control unit for operating the wheels and moving the cleaning machine along the drive surface and for operating the turbine for exerting a thrust able to keep the body in contact with the surface. The automatic cleaning machine also comprises at least one chopping element interposed between the suction inlet and the outlet mouth.

11 Claims, 4 Drawing Sheets

AUTOMATIC SWIMMING POOL CLEANING MACHINE

CROSS-REFERENCE TO RELATED APPLICATION

This Application claims the benefit of priority from European Patent Application No. 11425212.5, filed Aug. 4, 2011, the contents of which are incorporated herein by reference.

FIELD OF THE INVENTION

This invention relates to an automatic self-propelled device, or robot cleaner, for cleaning swimming pools.

BACKGROUND OF THE INVENTION

Prior art cleaning devices are known comprising self-propelled apparatuses which, after being immersed in a swimming pool, may move on the bottom and on the walls of the swimming pool for cleaning using brushes and a detritus suction circuit. These devices have turbines which can apply a downward thrust, for maintaining the contact between the device and the surface on which it moves. The inside of the device houses a collection filter which retains all the impurities sucked in. These devices require the intervention of an operator to perform the complete work cycle, and in particular for cleaning the filters and/or removing the device from the swimming pool after completing the work.

Consequently, these prior art devices have a number of drawbacks due to the relatively complex maintenance and due to the need in any case for manual intervention by the user. Moreover, the filters may become accidentally blocked thereby obstructing the water cleaning operation.

BRIEF SUMMARY OF THE INVENTION

A first aim of this invention is to provide an automatic cleaning machine for swimming pools which does not require the intervention of the user at the end of every single work cycle.

A second aim of this invention is to provide an automatic cleaning machine which can move on the vertical walls of the swimming pool in an efficient and safe manner, to perform the cleaning.

A further aim is to make an automatic cleaning machine which is structurally simpler and free from malfunctions due to lack of maintenance and/or cleaning of the machine.

The technical purpose indicated and the aims specified are substantially achieved by an automatic cleaning machine for swimming pools comprising the technical features described in one or more of the appended claims.

BRIEF DESCRIPTION OF THE DRAWINGS

Further features and advantages of the invention are more apparent in the non-limiting description which follows of a preferred non-limiting embodiment of an automatic cleaning machine illustrated in the accompanying drawings, in which.

DETAILED DESCRIPTION OF THE INVENTION

Figure 1:
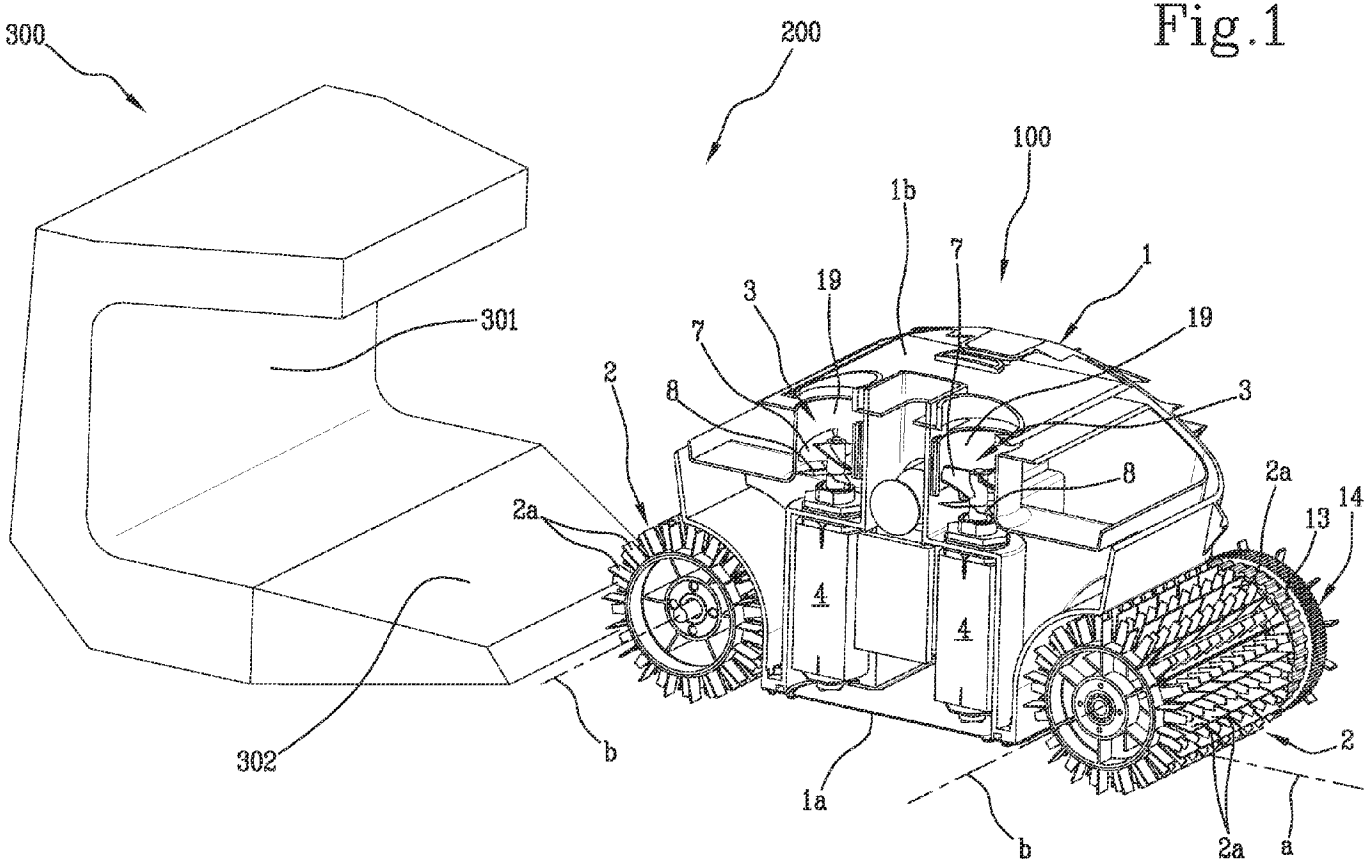
FIG. 1 is a perspective view of the automatic cleaning machine according to this invention, partly cut-away for greater clarity of several internal details, and about to re-enter into a recharging base.
Figure 2:
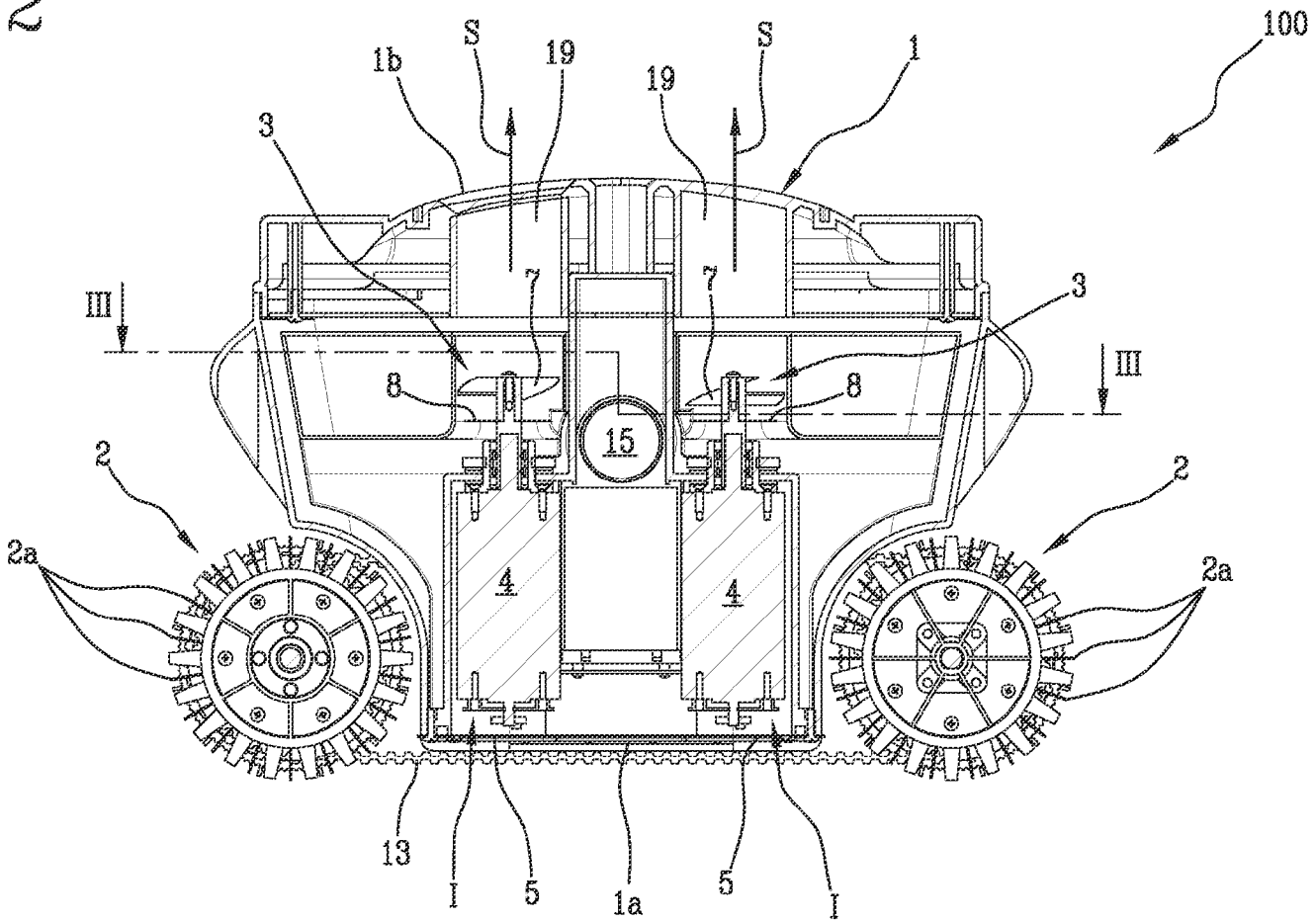
FIG. 2 is a lateral cross-section of the cleaning machine according to this invention.
Figure 3:
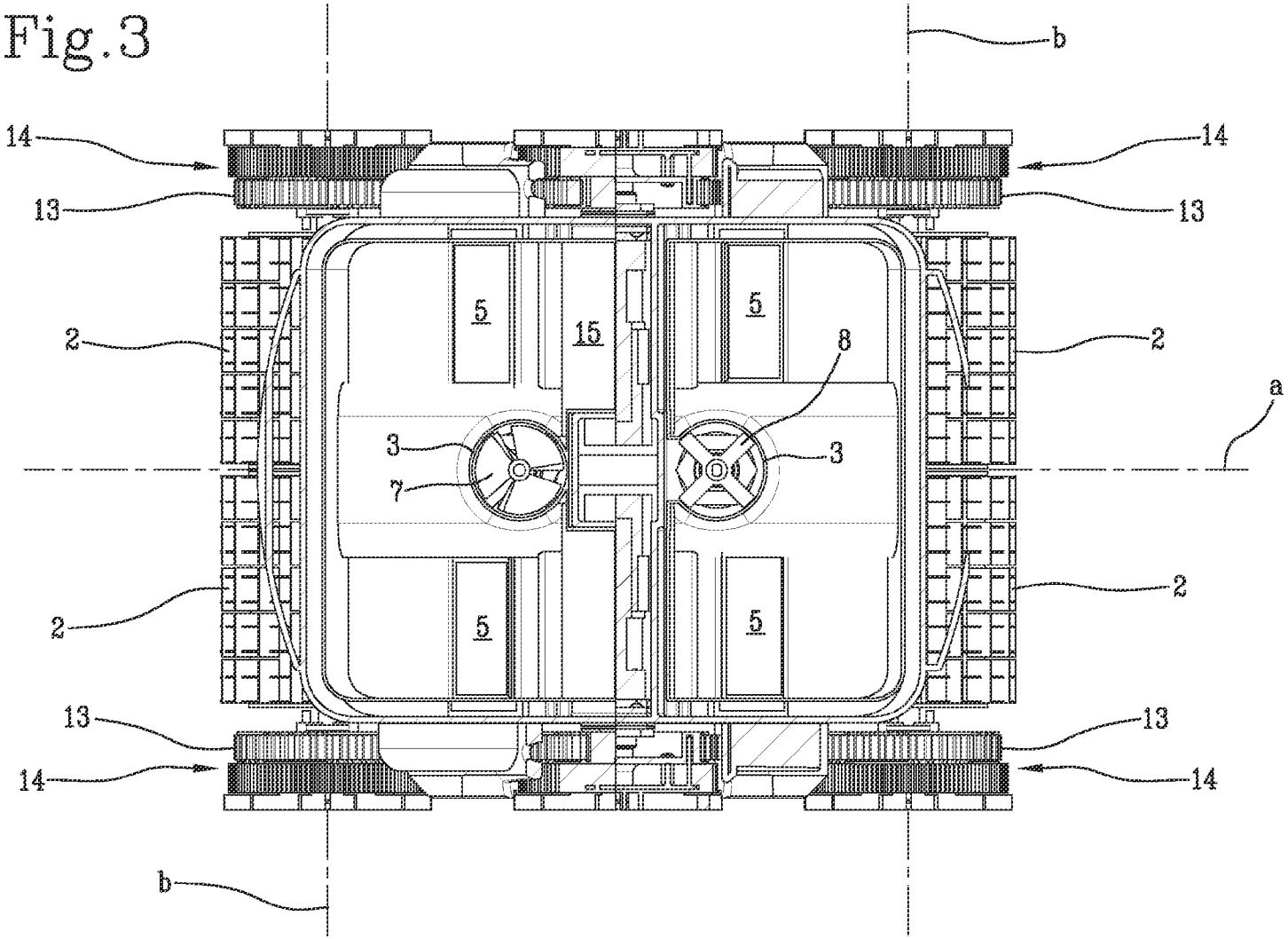
FIG. 3 is a top view, cross-sectioned along the plane C-C, of the machine according to FIG. 2.
Figure 4:
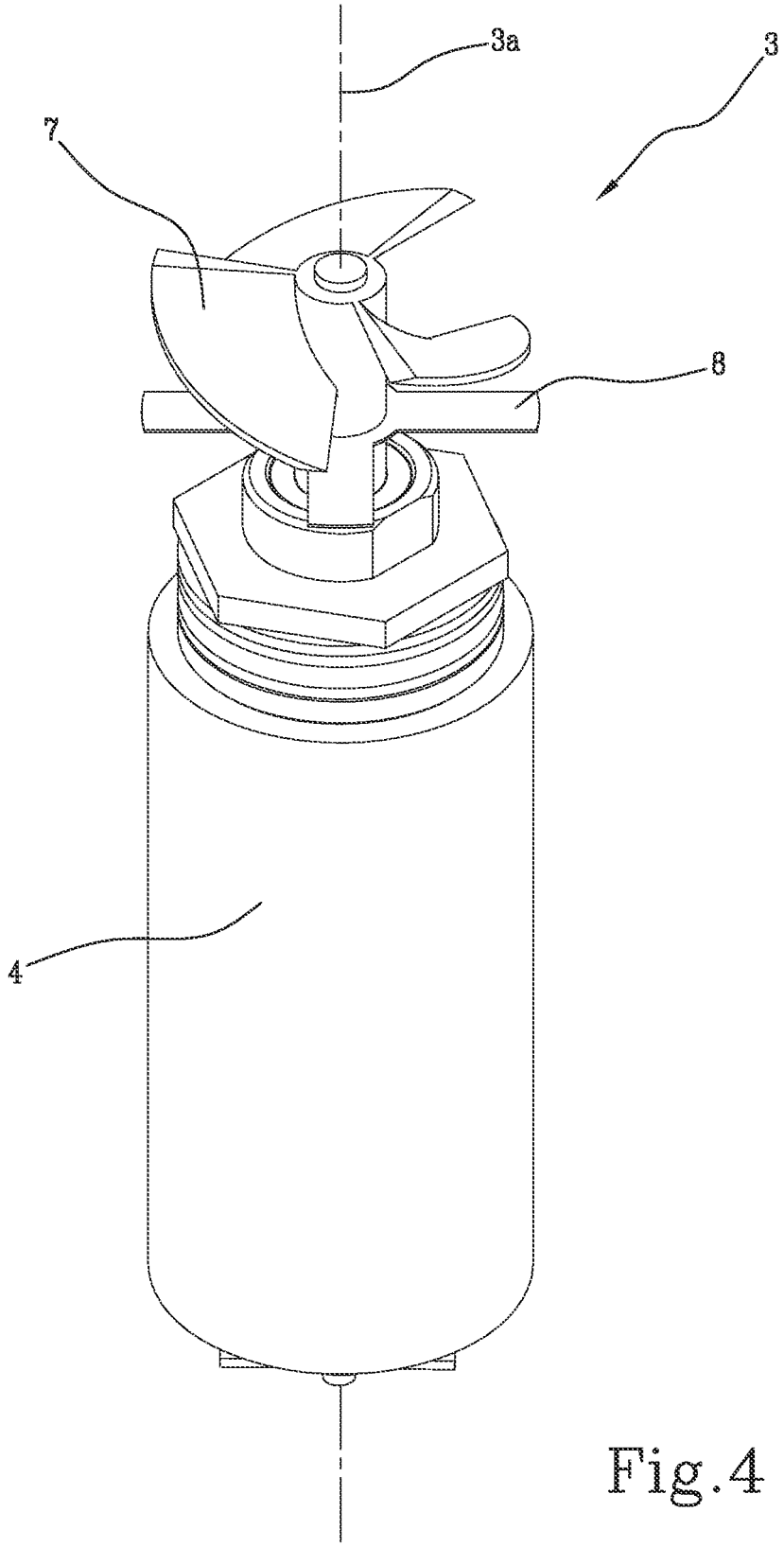
FIG. 4 is a perspective view of a component of the automatic cleaning machine according to this invention.

With reference to the accompanying drawings, an automatic cleaning machine 100 according to this invention basically comprises a body or outer guard 1, with longitudinal axis "a", and at least two drive wheels 2 with a transversal axis in direction "b", equipped with at least one electric motor 15. The drive wheels 2 are preferably equipped with an abrasive surface 2*a* or brushes 2*a* which remove dirt and detritus from the bottom and the walls of the swimming pool.

The cleaning machine 100 also comprises at least one, preferably two, independent thrust turbines 3, for balancing the forces on the axis of the machine positioned along the longitudinal axis "a" on the back of the body 1. The thrust turbines 3 push the cleaning machine 100 against the bottom of the swimming pool or even against the vertical wall to be cleaned.

Each turbine 3 comprises a body 4 housing a drive motor and at least one fan 7, driven by the motor.

One or more suction inlets 5 are provided on a lower surface 1*a* of the body 1. From here the detritus is sucked and conveyed upwards (according to the arrow I), towards one or more outlet mouths 19 positioned, preferably, on an upper surface lb of the body 1.

The cleaning machine 100 also comprises at least one chopping element 8 interposed between one of the suction inlets 5 and an outlet mouth 19.

The chopping element 8 is, preferably, associated with a respective turbine 3 mounted directly on the same axis of rotation 3*a* of the turbine 3.

Advantageously, in the configuration illustrated in the accompanying drawings, the machine 100 comprises at least two chopping elements 8, each associated with a respective turbine 3.

The chopping element 8 comprises at least one blade 6 chopping the detritus sucked by the fan 7 through the suction inlet 5.

Advantageously, the chopping element 8 comprises a plurality of blades rotating about the axis of rotation 3*a* of the turbine 3.

After sucking, the detritus and the dirt is re-sucked upwards by means of the fans 7 of the turbines 3, chopped up and discharged again into the swimming pool through the outlet mouths 19 (as indicated by arrow S).

That way, the dirt, suitably reduced in size, is lighter and does not fall to the bottom but floats, thereby being sucked and trapped by the main filters of the swimming pool.

The automatic cleaning machine 100 also comprises one or more position sensors, for detecting the inclination of the cleaning machine relative to the vertical and identifying whether the cleaning is being performed on the bottom or on a vertical wall, and one or more floating sensors, for detecting the presence of the water level.

Advantageously, the cleaning machine 100 is equipped with an electronic control unit interfaced with the turbines 3 with the motor 15 and with any sensors, for executing a memorized automatic work cycle.

FIG. 1 illustrates an apparatus for the cleaning of swimming pools 200 comprising a cleaning machine 100 according to this invention and a base 300 for automatic re-entry of the cleaning machine 100.

The base 300 comprises a containment compartment 301 and a chute 302 for facilitating re-entry of the machine 100. Moreover, the base 300 is equipped with an external power supply, preferably low voltage, in which a power supply plug for the cleaning machine, preferably of the inductive and/or capacitive type, may be automatically inserted.

Advantageously, the cleaning machine 100 is moved by the pulley 14 which, through a toothed belt 13, transfers the drive from a motor 15 to the wheels 2 of the machine.

According to this technical solution, the turbines 3 push the cleaning machine 100 against the bottom of the swimming pool or even against the vertical wall to be cleaned, whilst the operation of the wheels 2 defines the trajectory traveled by the cleaning machine on the work surface.

A suitable sensor, for example an impact sensor integral with the body 1 (not illustrated), communicates with the electronic control unit when the front of the cleaning machine 1 has struck an obstacle; this normally occurs when the cleaning machine is on the bottom of the swimming pool and encounters a vertical wall when moving.

After reaching a vertical wall, the cleaning machine may start to climb along the wall deactivating or reversing the pushing action exerted by the first turbine 3 located on the front area of the machine.

The front wheels 2 start to climb up the vertical wall, whilst the rear wheels continue to push the machine being pressed on the bottom by the action of the rear turbine 3, until the cleaning machine reaches the vertical position.

At this point, the turbines 3 are again both activated for pushing, to allow the cleaning machine to remain adherent and move along the wall.

The position of the machine, horizontal if on the bottom or vertical if on the walls, is communicated to the electronic control unit by the position sensor, for example an inertial type sensor.

When the cleaning machine has finished its work cycle, the procedure starts for re-entering the recharging base 300.

The cleaning machine ascends to the surface until reaching the water level determined by the position sensor.

The cleaning machine maintains a stable position on the surface by using a floating sensor.

The automatic cleaning machine according to this invention differs from conventional models by its complete operational autonomy being able to automatically return to the base 300 mounted in the swimming pool or, with the use of a suitable guide chute 302, outside the swimming pool (FIG. 1) for the purpose of recharging the batteries.

According to this invention, the machine is equipped with a power supply plug which inserts automatically into an electricity socket provided in the base.

Advantageously, the recharging may be performed by electrical connections, made directly on the back of the body 1.

More specifically, when the cleaning machine re-enters the base 300, the above-mentioned connections make contact with respective connections made inside the base 300 which are, in turn, connected to the external power supply socket.

The power is preferably supplied by a plug/socket coupling of the low voltage inductive type (e.g. 12V/24 V), to avoid any possible contact between metal parts and mains electricity supply in the presence of water.

Once in the base 300, the cleaning machine 100 starts recharging its batteries.

The turbines 3 may be positioned as shown in the accompanying drawings, that is, with the blades of the fan 7 in the upper part of the cleaning machine, or upside down with respect to the configuration illustrated, for obtaining a lower point for drawing the water and, therefore, more advantageous for pushing upwards when moving on the surface.

When the batteries of the cleaning machine are completely charged and the set work time starts, the cleaning machine automatically leaves the base 300 for starting a new work cycle.

From the description so far the advantage of this invention is evident compared with conventional cleaning devices, which need the intervention of the user both at the start of the cleaning cycle (the cleaning device must be immersed in the water) and at the end (the cleaning device must be taken out) and in which the user must clean the filter by hand.

The cleaning machine according to this invention deals with these problems with an automated mechanism, returning the cleaning machine to the recharging base 300 when the work cycle is finished.

An advantageous aspect of the cleaning machine according to this invention, and of fundamental importance, is the structural and operational simplicity compared with the prior are cleaning devices.

The cleaning machine described has no collection filter, which represents a structural complication as well as constituting an operational limitation, as it is easily clogged, and it is a further obligation for the user who, at the end of each work cycle, must clean it and ensure that it is free from dirt and detritus for the subsequent work cycle.

The machine in accordance with this invention allows the main filter of the swimming pool to be used directly. In effect, the automatic cleaning machine, moving according to a predetermined algorithm, shifts the dirt from the walls and chops the material, such as leaves, present on the bottom making it light in weight and returning it into the swimming pool. The water, containing chopped up detritus, will be filtered and the dirt will be sucked out by the cleaning system already present in the swimming pool.

A constructionally simple automatic cleaning machine is therefore obtained which, once its cycle is finished, recharges itself after directly reaching the base on the surface or on the bottom of the swimming pool, as there is no longer the need to have a location for unloading the dirt.

What is claimed is:

1. An automatic swimming pool cleaning machine comprising:

a body with at least two motorized wheels for moving on a drive surface;

at least one suction inlet positioned on a lower surface of the body;

at least one outlet mouth;

two turbines, operating between the suction inlet and the outlet mouth, controllable by respective electricity supply batteries; and an electronic control unit for operating the wheels and moving the cleaning machine along the drive surface and for operating the turbines for exerting a thrust able to keep the body in contact with the surface, wherein said cleaning machine further comprises, for each turbine, a respective chopping element mounted directly on a rotation shaft of the respective turbine and interposed between the suction inlet and the outlet mouth.

2. The cleaning machine according to claim 1, wherein each chopping element is associated with the respective turbine, mounted directly on the same axis of rotation as the respective turbine.

3. The cleaning machine according to claim 1, wherein each chopping element comprises at least one blade chopping the detritus sucked in by the suction inlet.

4. The cleaning machine according to claim 1, wherein it comprises horizontal or vertical cleaning machine position sensors.

5. The cleaning machine according to claim 1, wherein sensors are provided for detecting the presence of the water level.

6. The cleaning machine according to claim 1, comprising an electrical power supply recharging plug.

7. The cleaning machine according to claim 6, wherein the power supply plug is of the inductive or capacitive type.

8. The cleaning machine according to claim 1, wherein the electronic control unit is a unit programmable according to predetermined work cycles.

9. The cleaning machine according to claim 1, wherein the turbines are positioned offset along a longitudinal drive axis of the body and driven individually for varying the related thrust with respect to the drive surface.

10. A device for cleaning swimming pools, comprising a cleaning machine according to claim 1 and also comprising a base for automatic re-entry of the cleaning machine equipped with a seat for housing the body and a chute for positioning the machine inside the seat.

11. The device according to claim 10, wherein the base comprises and external power supply of the inductive or capacitive type.

* * * * *